US007733022B2

(12) United States Patent
Kim et al.

(10) Patent No.: US 7,733,022 B2
(45) Date of Patent: Jun. 8, 2010

(54) PLASMA DISPLAY PANEL

(75) Inventors: Deok Soo Kim, Gumi-si (KR); Byung Chul Lee, Gumi-si (KR); Jin Young Kim, Daegu (KR); Yun Gi Kim, Busan (KR); Sung Gon Shin, Gyeongsangnam-do (KR); Sung Min Jun, Busan (KR)

(73) Assignee: LG Electronics Inc., Seoul (KR)

( * ) Notice: Subject to any disclaimer, the term of this patent is extended or adjusted under 35 U.S.C. 154(b) by 341 days.

(21) Appl. No.: 11/035,044

(22) Filed: Jan. 14, 2005

(65) Prior Publication Data

US 2005/0179381 A1 Aug. 18, 2005

(30) Foreign Application Priority Data

Jan. 16, 2004 (KR) ..... 10-2004-0003208
Oct. 15, 2004 (KR) ..... 10-2004-0082728

(51) Int. Cl.
*H01J 17/49* (2006.01)

(52) U.S. Cl. ..... 313/582; 313/45; 313/590; 313/238; 313/269

(58) Field of Classification Search ..... 313/582, 313/580, 590, 479, 238, 269, 46
See application file for complete search history.

(56) References Cited

U.S. PATENT DOCUMENTS 6,522,069 B1 * 2/2003 Hong et al. ..... 313/582
6,570,339 B1 5/2003 Moore
6,833,665 B2 * 12/2004 Wachi et al. ..... 313/479
6,856,076 B2 * 2/2005 Kim et al. ..... 313/46
6,979,243 B2 * 12/2005 Watanabe ..... 445/24
7,183,499 B2 * 2/2007 Hashimoto et al. ..... 174/389
7,235,922 B2 * 6/2007 Jun et al. ..... 313/582
7,432,653 B2 * 10/2008 Jun et al. ..... 313/582
2003/0071551 A1 * 4/2003 Kim et al. ..... 313/46
2006/0125364 A1 * 6/2006 Takeda et al. ..... 313/46

FOREIGN PATENT DOCUMENTS

EP 0 910 107 A1 4/1999
EP 1069815 1/2001
EP 1196018 A1 4/2002
EP 1339082 8/2003
EP 1357574 10/2003

(Continued)

*Primary Examiner*—Ashok Patel
(74) *Attorney, Agent, or Firm*—McKenna Long & Aldridge LLP

(57) ABSTRACT

Disclosed herein is a plasma display panel in which afterimage is improved. The plasma display panel according to the present invention includes a panel unit having an upper plate and a lower plate, a frame that supports circuitry, and a conductive material formed between the panel unit and the frame. As such, a conductive material is formed on a bottom surface of a lower plate of a panel. Thus, charges introduced into the lower plate are properly controlled to improve the waveform stability of the panel. Also, a charge characteristic is improved to implement a stable operation. Accordingly, an afterimage time can be reduced. Further, a sheet of a low hardness and light weight is used. It is thus possible to absorb shock and noise of a PDP, accomplish light weight of the PDP and reduce the materials of the sheet.

45 Claims, 5 Drawing Sheets

FOREIGN PATENT DOCUMENTS

| | | | |
|---|---|---|---|
| EP | 1 378 926 | A3 | 9/2005 |
| JP | 10-117081 | | 5/1998 |
| JP | 2001-034177 | | 2/2001 |
| JP | 2003-066862 | A | 3/2003 |
| JP | 2004-004705 | | 1/2004 |
| JP | 2005-107487 | | 4/2005 |
| KR | 1020030033265 | A | 5/2003 |

* cited by examiner

Related Art

PLASMA DISPLAY PANEL

This Nonprovisional application claims priority under 35 U.S.C. § 119(a) on Patent Application No. 10-2004-0003208 filed in Korea on Jan. 16, 2004, Patent Application No. 10-2004-0082728 filed in Korea on Oct. 15, 2004, the entire contents of which are hereby incorporated by reference.

BACKGROUND OF THE INVENTION

1. Field of the Invention

The present invention relates to a plasma display panel. More particularly, the present invention relates to a plasma display panel in which afterimage is reduced, wherein a conductive material is formed on a bottom surface of a lower plate of the panel to properly control charges introduced into the lower plate, whereby waveform stability of the panel and a charge characteristic are improved to implement a stable operation. Further, the present invention relates to a plasma display panel, which is adapted to absorb shock and noise and also suitable for light weight 2. Description of the Background Art Recently, the development of high definition television (HDTV) has been partially completed. While research on its improvement is continuously made, an image display device (or a picture display device) has become more important. As known already, the type of the image display device can include a cathode-ray tube (CRT), a liquid display device (LCD), a vacuum fluorescent display (VFD), a plasma display panel (hereinafter, referred to as "PDP"), and the like.

However, a display device, which is satisfactory to HDTV, has not yet been completed in terms of technology. Thus, those display devices have been developed at a different field in a complementary manner.

A PDP of the above-described image display devices is adapted to display an image by way of a gas discharge. The PDP has the highest resolution and contrast ratio and a rapid response speed, and is suitable for displaying an image of a large area. Thus, it has been widely used for television, monitors, display boards for advertising and so on.

FIG. 1 is a dismantled perspective view illustrating the construction of a conventional PDP. FIG. 2 is a cross-sectional view showing a state where the conventional PDP is coupled.

Referring to FIGS. 1 and 2, the PDP has a front substrate 10 being a display surface on which an image is displayed, and a rear substrate 20 constituting a rear surface. The front substrate 10 and the rear substrate 20 are coupled parallel to each other with a given distance therebetween.

Sustain electrodes 11 for sustaining emission of a cell through inter-discharge in one pixel are disposed in pairs at the bottom of the front substrate 10. The sustain electrodes 11 serve to limit the discharge current, and are covered with a dielectric layer 12 for insulation among the electrode pairs. A protection layer 13 is formed on the opposite surface to the surface of the dielectric layer 12, which covers the sustain electrodes 11.

The rear substrate 20 includes a plurality of discharge spaces, i.e., barrier ribs 21 of a stripe type, for forming a cell, and a plurality of address electrodes 22 for performing an address discharge at portions where the address electrodes 22 and the sustain electrodes 11 intersect to generate vacuum ultraviolet. In this time, the barrier ribs 21 are arranged parallel to one another. The address electrodes 22 are disposed parallel to the barrier ribs 21.

Further, R.G.B phosphor layers 23 that emits a visible ray for displaying an image in an address discharge are coated on the top surface of the rear substrate 20 except for the top of the barrier ribs 21.

However, this PDP has a problem in that afterimage is generated. For example, if a first image is switched to a second image after being turned on for a predetermined time, the time when the first image disappears is lengthened as long as several minutes to several tens of minutes. Also, even when an image is switched, a previous image is overlapped with a later image. Thus, the picture quality is degraded.

Furthermore, the conventional PDP has problems in that it generates lots of noise, and is weak in shock and relatively heavy.

SUMMARY OF THE INVENTION

Accordingly, an object of the present invention is to solve at least the problems and disadvantages of the background art.

The object of the present invention is to provide a plasma display panel which is adapted to absorb shock and noise and also suitable for light weight.

According to an aspect of the present invention, there is provided a plasma display panel, including a panel unit having an upper plate and a lower plate, a frame that supports circuitry, and a conductive material formed between the panel unit and the frame.

According to another aspect of the present invention, there is provided a plasma display panel, including a sheet comprising one or more of silicon, urethane foam and acryl, and at least one metal layer laminated on the sheet.

According to still another aspect of the present invention, there is provided a plasma display panel, including a sheet comprising one or more of silicon, urethane foam and acryl, and at least one metal layer formed between the sheet and the lower plate, which are opposite to each other, wherein the hardness of the sheet is Asker C 15 to 30, and a thickness from the surface of the lower plate, which is opposite to the sheet, to the sheet ranges from 0.2 to 1 mm.

The present invention is advantageous in that it can reduce an afterimage time. Further, according to the present invention, a sheet of a low hardness and light weight is used. It is thus possible to absorb shock and noise of a PDP, accomplish light weight of the PDP and reduce the materials of the sheet.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
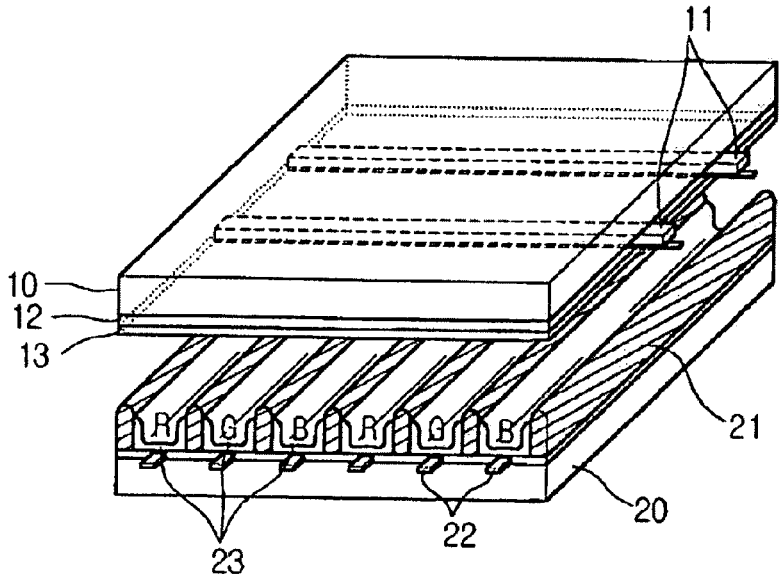
FIG. 1 is a dismantled perspective view illustrating the construction of a conventional PDP.
Figure 2:
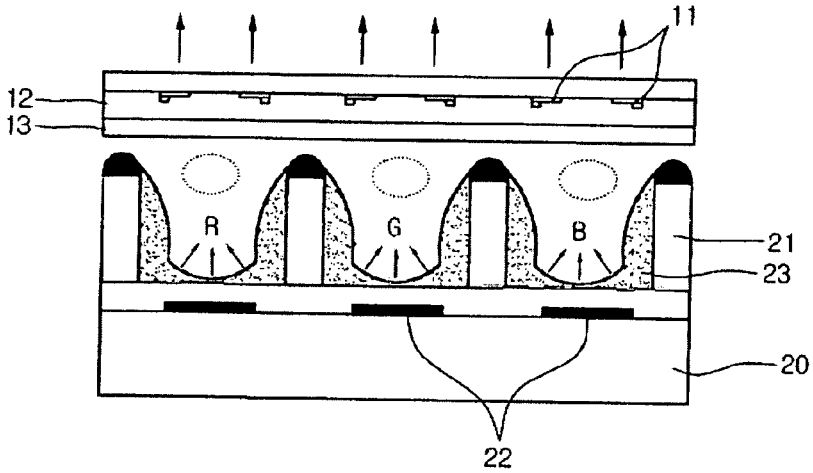
Related Art Fig. 2
FIG. 2 is a cross-sectional view showing a state where the conventional PDP is coupled.

Preferred embodiments of the present invention will be described in a more detailed manner with reference to the drawings.

According to an aspect of the present invention, there is provided a plasma display panel, including a panel unit having an upper plate and a lower plate, a frame that supports circuitry, and a conductive material formed between the panel unit and the frame.

The conductive material is a conductive sheet having adhesive strength at least partially.

An insulating sheet for preventing electromagnetic waves generated from the panel from affecting peripheral elements or the circuitry is attached to one side of the conductive material.

A sheet having flexibility is attached to one side of the conductive material.

The conductive material is a metal-coated film, which is not formed separately but coated on one side of the panel in the form of a film.

The metal-coated film is formed by a spray method, a painting method or a sputtering method.

The conductive material is formed by a printing method using a conductive paste.

The conductive material is formed by using one or more of silver (Ag), copper (Cu) and aluminum (Al).

The conductive material is laminated in a floating state.

The conductive material is grounded to peripheral elements or the circuitry.

According to another aspect of the present invention, there is provided a plasma display panel, including a sheet comprising one or more of silicon, urethane foam and acryl, and at least one metal layer laminated on the sheet.

The sheet having the metal layer laminated thereon is located between the panel unit and the frame.

The PDP further includes an adhesive layer for adhering the metal layer and the panel unit.

A total thickness of the adhesive layer, the metal layer and the sheet ranges from 0.2 to 1 mm.

A total thickness of the adhesive layer, the metal layer and the sheet ranges from 0.6 mm to 0.95 mm.

The urethane foam comprises a plurality of fine holes.

The fine holes are filled with one of the silicon and the acryl.

The hardness of the adhesive layer, the metal layer and the sheet is Asker C 15 to 30.

The hardness of the adhesive layer, the metal layer and the sheet is Asker C 20 to 25.

The metal layer includes one or more of silver (Ag), copper (Cu) and aluminum (Al).

A thickness of the metal layer ranges from 0.01 mm to 0.3 mm.

The metal layer comprises a plurality of slits.

The width of the slits ranges from 0.05 mm to 1 mm.

The acryl has viscosity.

The sheet includes a plurality of fine holes entrained within the viscous acryl.

The PDP according to the present invention includes a sheet having one or more of silicon, urethane foam and acryl.

According to still another aspect of the present invention, there is provided a plasma display panel, including a sheet comprising one or more of silicon, urethane foam and acryl, and at least one metal layer formed between the sheet and the lower plate, which are opposite to each other, wherein the hardness of the sheet is Asker C 15 to 30, and a thickness from the surface of the lower plate, which is opposite to the sheet, to the sheet ranges from 0.2 to 1 mm.

Figure 3:
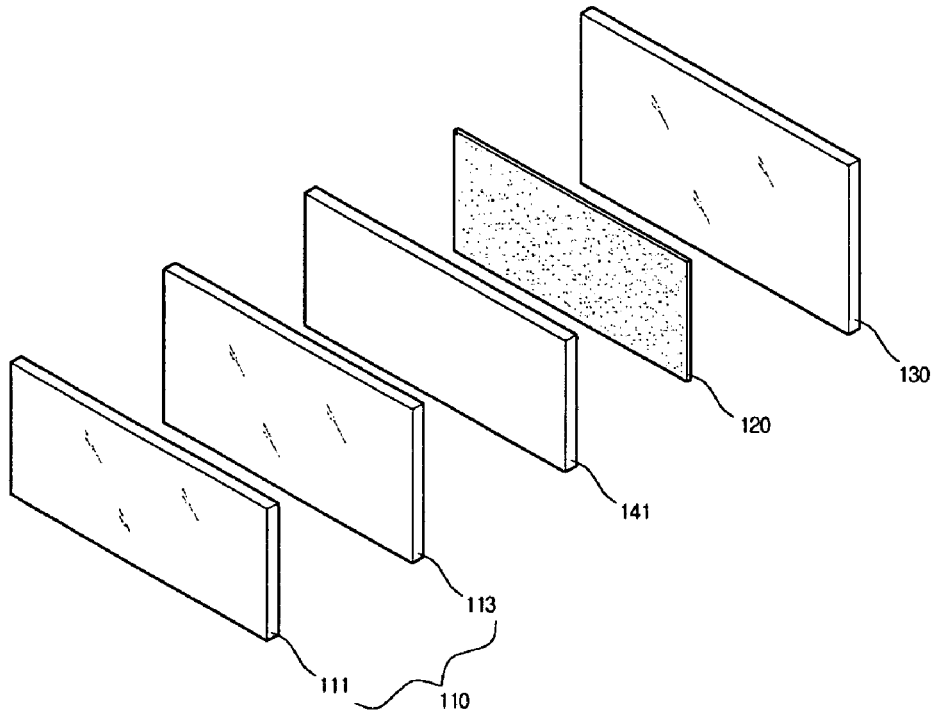
FIG. 3 is a dismantled perspective view illustrating the construction a PDP according to a first embodiment of the present invention.

FIG. 3 is a dismantled perspective view illustrating the construction a PDP according to a first embodiment of the present invention.

Referring to FIG. 3, the PDP according to the present invention includes a panel unit 110 having an upper plate 111 and a lower plate 113, a metal layer 141 laminated on a bottom surface of the lower plate 113 of the panel unit 110, a sheet 120 formed on a bottom surface of the metal layer 141, and a frame 130 disposed opposite to the panel unit 110 with the metal layer 141 and the sheet 120 located therebetween.

The metal layer 141 can be formed on the bottom surface of the lower plate 113 by coating a conductive paste on a glass substrate of the lower plate 113 or coating a metal on the glass substrate of the lower plate 113 by means of a sputtering method, etc. The metal layer 141 is formed on the lower plate 113 in a floating state. The metal layer 141 has influence upon charges, which are introduced into the lower plate 113, to improve the waveform stability of the panel unit 110. It also improves a charge characteristic to implement a stable operation. If the metal layer 141 is formed on the panel unit 110, as such, and is then electrically floated, the amount of remaining charges that generate afterimage is reduced, and the afterimage is thus reduced. Also, the metal layer 141 can be grounded to a ground voltage (GND) so as to induce discharging of remaining charges.

The sheet 120 can be formed using a material, which has low thermal resistance, elasticity and easy adhesive strength with a metal layer, for example, one or more of acryl, silicon and urethane having viscosity. The sheet 120 serves both as a damper to reduce shock and noise and a heat sink to transfer heat of the panel unit 110, which is transferred via the metal layer 141, to the frame 130. An example of the sheet 120 can include a heat sink sheet of a porous structure, which includes silicon and urethane foam, which was proposed in Korean Patent Application No. 2002-0039179 the applicant of which is the same as that of this application.

The frame 130 can be formed using an aluminum material having high thermal conductivity. The sheet 120 is adhered between the rear surface of the panel unit 110 and the frame 130. The sheet 120 can include viscous acryl or an acryl-based adhesive for rapidly transferring heat generated from the metal layer 141 to the frame 130. Thus, the sheet 120 can adhere to the metal layer 141 and the frame 130 at high pressure in a strong and uniform manner.

Figure 4:
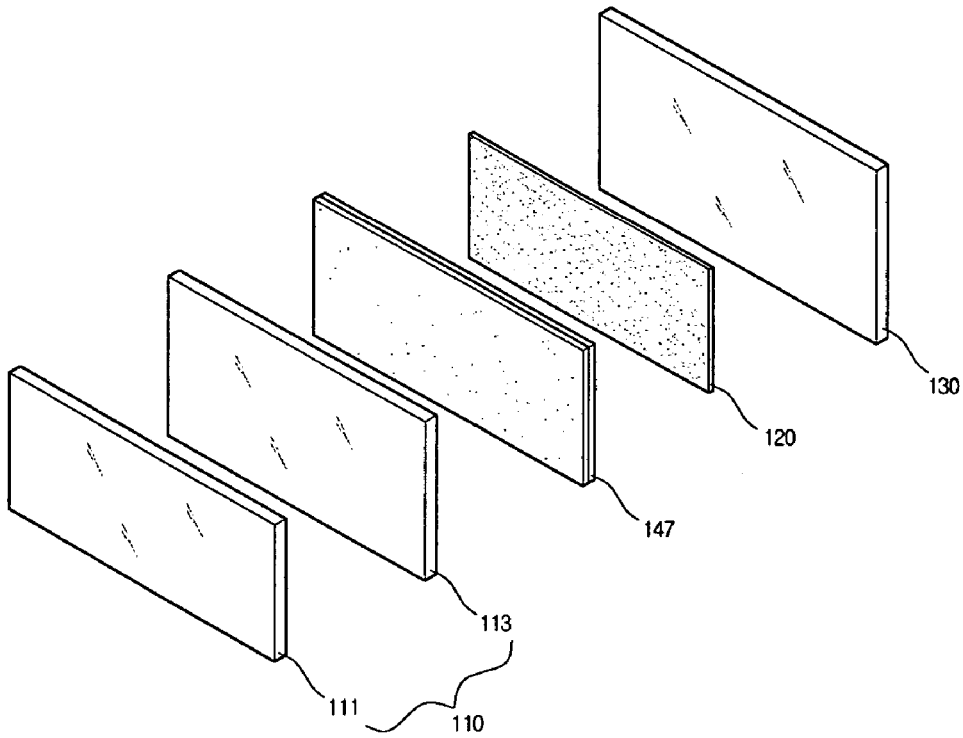
FIG. 4 is a dismantled perspective view illustrating the construction a PDP according to a second embodiment of the present invention.

FIG. 4 is a dismantled perspective view illustrating the construction a PDP according to a second embodiment of the present invention.

Referring to FIG. 4, the PDP according to the present invention includes a panel unit 110 having an upper plate 111 and a lower plate 113, a metal tape 147 adhered to a bottom surface of the lower plate 113 of the panel unit 110, a sheet 120 attached to a bottom surface of the metal tape 147, and a frame 130 adhered to the panel unit 110 through the sheet 120, wherein the frame 130 radiates heat transferred through the sheet 120.

It is preferred that the metal tape 147 has an adhesive at least on one side for the purpose of adhesion with the panel unit 110 and/or the sheet 120, and the adhesive has conductivity. The metal tape 147 can be attached to the lower plate 113 in a floating state, or can be grounded to a ground voltage (GND).

Figure 5:
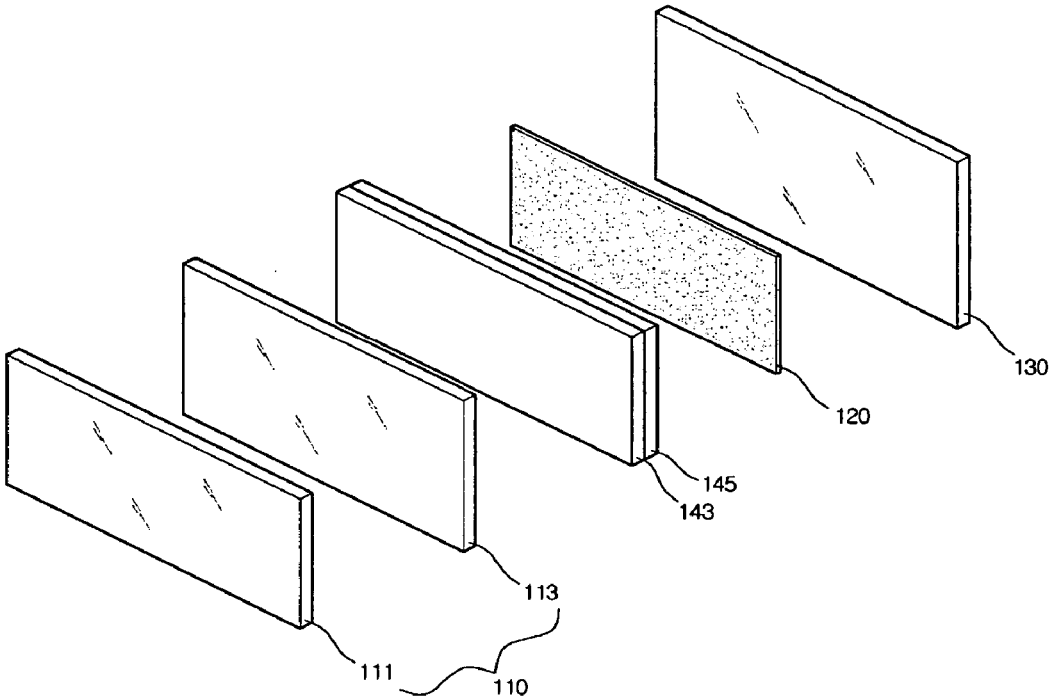
FIG. 5 is a dismantled perspective view illustrating the construction a PDP according to a third embodiment of the present invention.

FIG. 5 is a dismantled perspective view illustrating the construction a PDP according to a third embodiment of the present invention.

Referring to FIG. 5, the PDP according to the present invention includes a panel unit 110 having an upper plate 111 and a lower plate 113, a metal sheet 143 laminated on a bottom surface of the lower plate 113 of the panel unit 110, an insulating sheet 145 laminated on a bottom surface of the metal sheet 143, a sheet 120 attached to a bottom surface of the insulating sheet 145, and a frame 130 adhered to the panel unit 110 through the sheet 120, wherein the frame 130 radiates heat transferred through the sheet 120.

The metal sheet 143 and the insulating sheet 145 can be used with them melted/compressed into one. The metal sheet 143 has influence upon remaining charges that are introduced into the lower plate 113. The metal sheet 143 can be attached to the lower plate 113 in a floating state, or can be grounded to a ground voltage (GND).

The insulating sheet 145 serves to prevent electromagnetic waves that are generated from the panel unit 110 from affecting circuitry.

Figure 6:
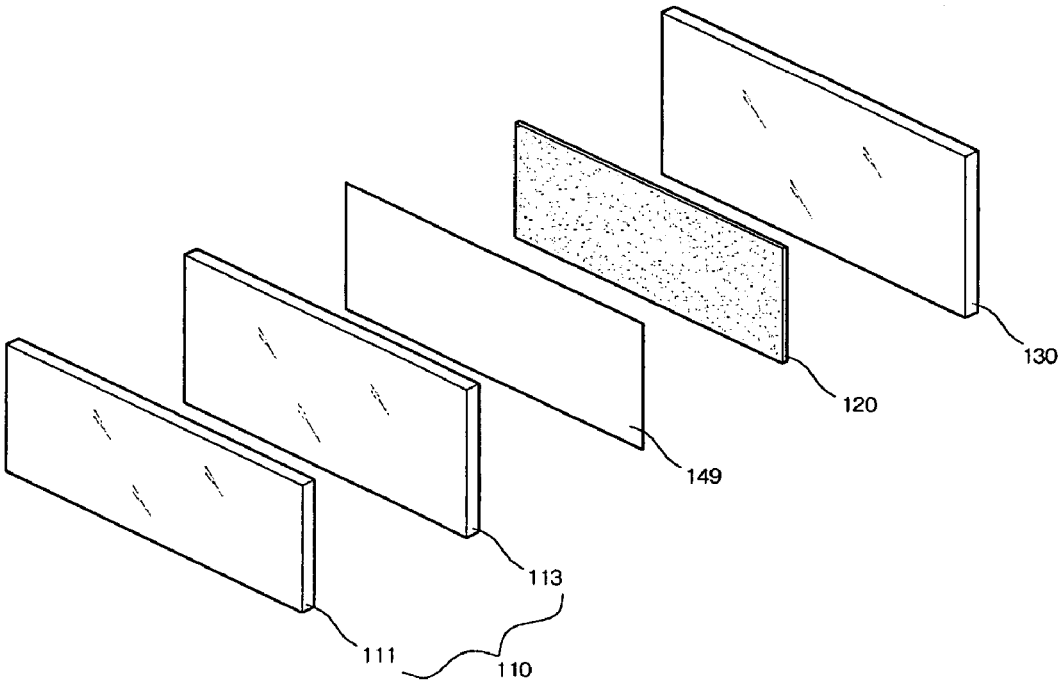
FIG. 6 is a dismantled perspective view illustrating the construction a PDP according to a fourth embodiment of the present invention.

FIG. 6 is a dismantled perspective view illustrating the construction a PDP according to a fourth embodiment of the present invention.

Referring to FIG. 6, the PDP according to the present invention includes a panel unit 110 having an upper plate 111 and a lower plate 113, a metal-coated film 149 formed on a bottom surface of the lower plate 113 of the panel unit 110, a sheet 120 attached to a bottom surface of the metal-coated film 149, and a frame 130 adhered to the panel unit 110 through the sheet 120, wherein the frame 130 radiates heat transferred through the sheet 120.

The metal-coated film 149 can be formed on a glass substrate of the lower plate 113 by means of one of a spray method, a printing method, a painting method and a sputtering method. Furthermore, the metal-coated film 149 can be formed using a metal having high electrical and thermal conductivity, such as aluminum (Al), copper (Cu) or silver (Ag).

The metal-coated film 149 can be formed on the lower plate 113 in a floating state, or can be grounded to a ground voltage (GND).

Figure 7:
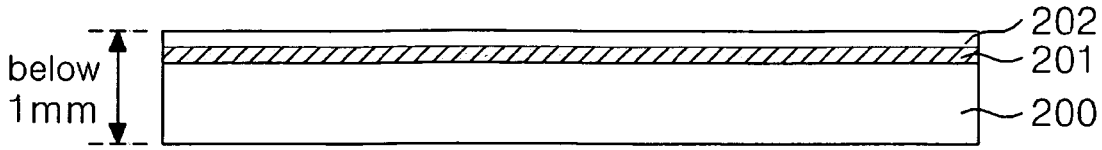
FIG. 7 is a cross-sectional view showing a sheet for a PDP according to a fifth embodiment of the present invention.

FIG. 7 is a cross-sectional view showing a sheet for a PDP according to a fifth embodiment of the present invention.

Referring to FIG. 7, the sheet for the PDP according to the present invention includes a basic material sheet 200 comprising one or more of silicon, urethane foam and acryl, and a metal layer 201 and an adhesive layer 202 sequentially laminated on the basic material sheet 200.

It is required that the sheet for the PDP have Asker C hardness 15 to 30, preferably 20 to 25 so that it serves as a damper to absorb shock and noise, and have low thermal resistance so that thermal conductivity is high. To this end, the basic material sheet 200 can be formed using a material of porosity, low thermal resistance and high elasticity, which has viscosity and a plurality of fine holes, such as a porous material composed of a combination of urethane foam and silicon, or a viscous acryl material of a porous structure through foaming. The metal layer 201 can be formed using a metal having high conductivity, such as aluminum (Al), copper (Cu) or silver (Ag).

Moreover, the sheet for the PDP has to be fabricated as thin as possible in order to accomplish light weight of the PDP and save the cost for materials.

In order to fulfill the above-described hardness condition and light weight, it is required that a total thickness of the sheet including the metal layer 201, the adhesive layer 202 and the basic material sheet 200 be 0.2 to 1 mm, preferably 0.6 mm to 0.95 mm. If the total thickness of the sheet ranges from 0.2 mm or less, noise and vibration characteristics of the panel are lowered. Further, it is required that a thickness of the metal layer 201 be 0.01 mm to 0.3 mm, preferably 0.02 mm to 0.03 mm. Meanwhile, with the help of advanced thin film technology, there is nothing problem in fabricating a sheet having a total thickness of 0.9 mm or less in view of a current manufacturing technology level.

If the total thickness of the sheet reduces, a heat sink effect can be improved and the cost for materials can be significantly reduced. For example, an experiment showed that if a thickness of a sheet reduces by 0.1 mm, a temperature of a PDP drops by 2° C. or more, and if the thickness of the sheet reduces from 1.2 mm to 0.9 mm, the material cost of the sheet reduces by about 10%.

In the present invention, in order to meet the above-described hardness condition, surface energy can be enhanced by increasing the foaming density of the basic material sheet 200, and a damping effect of the basic material sheet 200 for vibration, shock and noise can be optimized by improving the porosity.

Figure 8:
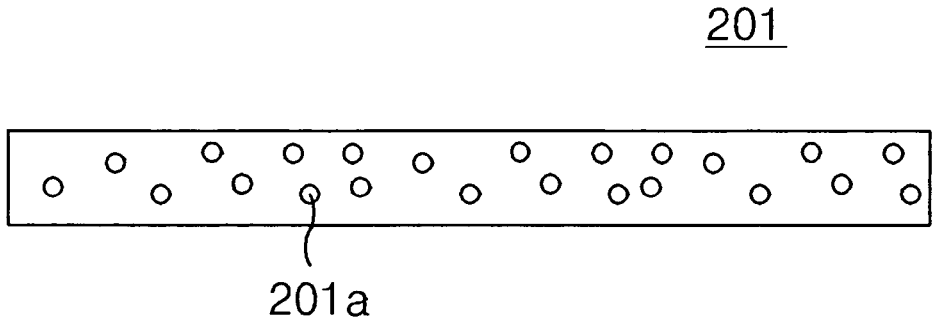
FIG. 8 is a dismantled perspective view illustrating the construction a PDP according to a sixth embodiment of the present invention.
Figure 9:
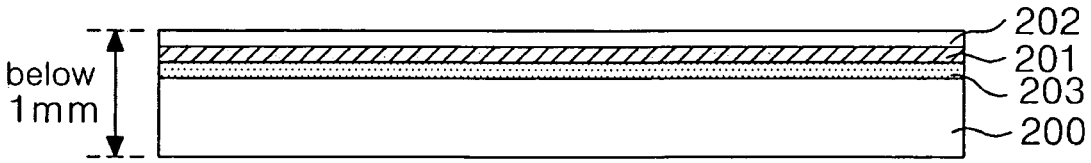
FIG. 9 is a dismantled perspective view illustrating the construction a PDP according to a seventh embodiment of the present invention.

If the basic material sheet 200 is made of a viscous urethane material having a porosity structure into which a plurality of fine holes 201*a* are entrained through foaming as shown in FIG. 8, the basic material sheet 200 and the metal layer 201 can adhere to each other without an additional adhesive. In the same manner, if the basic material sheet 200 is made of foamed viscous acryl, the basic material sheet 200 and the metal layer 201 can adhere to each other without an additional adhesive as shown in FIG. 7. On the contrary, if the basic material sheet 200 is made of silicon, a porous material in which silicon and urethane foam are combined, foamed acryl, a material in which urethane foam is combined, or the like, an additional adhesive 203 for adhering the basic material sheet 200 and the metal layer 201 is formed between the basic material sheet 200 and the metal layer 201, as shown in FIG. 9.

The adhesive layer 202 formed on the metal layer 201 can be formed using an any known adhesive such as an acryl-based adhesive, and it serves to adhere the metal layer 201 on the glass substrate of the lower plate of the panel unit of the PDP described in the above embodiment. Also, a releasing paper, which can be easily separated from the adhesive layer 202, can be formed on the adhesive layer 202 in order to prevent contamination.

The method of adhering the sheet on the glass substrate of the lower plate of the panel unit will be described below.

While the releasing paper on the adhesive layer 202 is peeled off, the sheet shown in FIG. 7 is adhered to the glass substrate of the panel unit by means of a lamination process using pressure and/or heat.

Figure 10A:
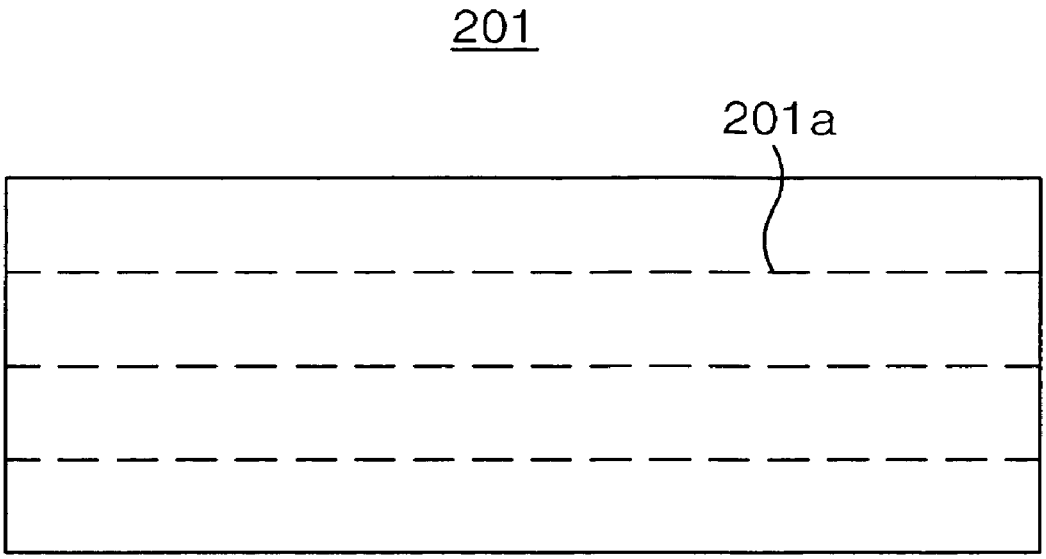
FIGS. 10*a* and 10*b* are views illustrating examples of slits formed in a metal layer in the PDP according to the present invention.
Figure 10B:
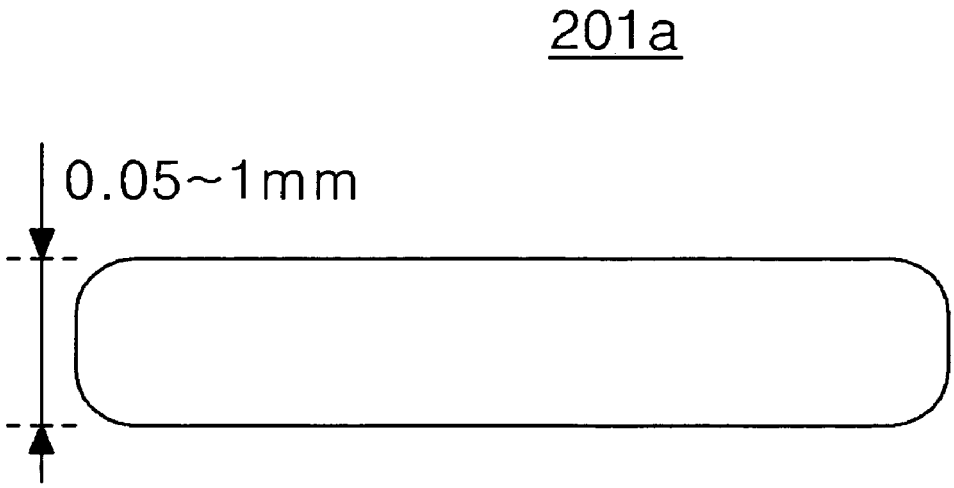

In this lamination process, an air layer or bubbles should not be included between the sheet shown in FIG. 7 and the glass substrate of the lower plate of the panel unit. For this purpose, a plurality of slits 201*a* for discharging air, which exists between the sheet and the panel unit during the process of laminating the sheet and the panel unit, can be formed in the metal layer 201, as shown in FIGS. 10*a* and 10*b*. The slits 201*a* can have a straight-line shape, as shown in FIG. 10*a*, or other shape such as "+". The width of the slits 201*a* is preferably 0.05 mm to 1 mm so that air can pass smoothly, as shown in FIG. 10*b*.

Meanwhile, the sheet for the PDP according to the present invention can have only the basic material sheet 200 made of viscous urethane, which has a porosity structure, without having the metal layer 201 and the adhesive layer 202. In this case, in order to fulfill the above hardness condition and light weight, it is required that a thickness of the basic material sheet 200 be 1 mm or less.

Furthermore, the sheet for the PDP according to the present invention can be formed using a combination of silicon and urethane foam without the metal layer 201, or can have a multi-layer sheet of a porous basic material sheet 200, which is made of foamed silicon or foamed acryl, and the adhesive layer 202. In this case, a total thickness of the adhesive layer 202 and the basic material sheet 200 has to be 1 mm or less so as to fulfill the aforementioned hardness and light weight condition.

Also, the basic material sheet 200 represents the color tone between white and black so that it absorbs light, which is back scattered from the panel unit through a rear glass substrate, to reduce the lowering in contrast of the picture quality, which is caused since the back scattered light reflects toward the panel unit. To this end, the basic material sheet 200 has carbon-based paints added thereto, and thus represents the color tone of gray.

As described above, according to the present invention, a conductive material is formed on a bottom surface of a lower plate of a panel. Thus, charges introduced into the lower plate are properly controlled to improve the waveform stability of the panel. Also, a charge characteristic is improved to implement a stable operation. Accordingly, the present invention is advantageous in that it can reduce an afterimage time. Further, according to the present invention, a sheet of a low hardness and light weight is used. It is thus possible to absorb shock and noise of a PDP, accomplish light weight of the PDP and reduce the materials of the sheet.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel including a panel unit having discharge spaces defined between an upper plate and a lower plate, and a frame disposed opposite to the panel unit, comprising:

a sheet comprising one or more of silicon, urethane foam and acryl; and at least one metal layer laminated on the sheet, wherein the thickness of the sheet is in the range of 1 mm to greater than 0 mm and wherein the sheet having the metal layer laminated thereon is located between the panel unit and the frame for supporting circuitry, the metal layer is formed between the panel unit and the sheet.

2. The plasma display panel as claimed in claim 1, further comprising an adhesive layer for adhering the sheet and the panel unit.

3. The plasma display panel as claimed in claim 2, wherein a thickness of the sheet including the adhesive layer ranges from 1 mm to greater than 0 mm.

4. The plasma display panel as claimed in claim 2, wherein a thickness of the sheet including the adhesive layer ranges from 0.6 mm to 0.95 mm.

5. The plasma display panel as claimed in claim 1, wherein the sheet is manufactured of urethane foam, wherein the urethane foam comprises a plurality of fine holes, and the fine holes are filled with one of the silicon and the acryl.

6. The plasma display panel as claimed in claim 1, wherein the hardness of the sheet is Asker C 15 to 30.

7. The plasma display panel as claimed in claim 6, wherein the hardness of the sheet is Asker C 20 to 25.

8. The plasma display panel as claimed in claim 1, wherein the sheet comprises foamed acryl.

9. The plasma display panel as claimed in claim 8, wherein the acryl has viscosity.

10. The plasma display panel as claimed in claim 9, wherein the sheet includes a plurality of fine holes entrained within the viscous acryl.

11. The plasma display panel as claimed in claim 1, wherein the sheet has the color tone of gray.

12. A plasma display panel including a panel unit having discharge spaces defined between an upper plate and a lower plate, and a frame disposed opposite to the panel unit, comprising:

a sheet comprising one or more of silicon, urethane foam and acryl; and at least one metal layer laminated on the sheet, wherein the sheet having the metal layer laminated thereon is located between the panel unit and the frame for supporting circuitry, the metal layer is formed between the panel unit and the sheet.

13. The plasma display panel as claimed in claim 12, wherein the metal layer is grounded to a ground voltage.

14. The plasma display panel as claimed in claim 12, wherein the sheet has the color tone of gray.

15. The plasma display panel as claimed in claim 12, wherein the sheet comprises foamed acryl.

16. The plasma display panel as claimed in claim 12, wherein the urethane foam comprises a plurality of fine holes, and the fine holes are filled with one of the silicon and the acryl.

17. The plasma display panel as claimed in claim 12, wherein the hardness of the sheet is Asker C 15 to 30.

18. The plasma display panel as claimed in claim 17, wherein the hardness of the sheet is Asker C 20 to 25.

19. The plasma display panel as claimed in claim 12, wherein the metal layer comprises one or more of silver (Ag), copper (Cu) and aluminum (Al).

20. The plasma display panel as claimed in claim 19, wherein a thickness of the metal layer ranges from 0.01 mm to 0.3 mm.

21. The plasma display panel as claimed in claim 12, wherein the metal layer comprises a plurality of slits.

22. The plasma display panel as claimed in claim 21, wherein the width of the slits ranges from 0.05 mm to 1 mm.

23. The plasma display panel as claimed in claim 12, wherein the acryl has viscosity.

24. The plasma display panel as claimed in claim 23, wherein the acryl undergoes a foaming process.

25. The plasma display panel as claimed in claim 24, wherein the sheet comprises a plurality of fine holes entrained within the viscous acryl.

26. The plasma display panel as claimed in claim 12, wherein the metal layer is in an electrically floating state.

27. The plasma display panel as claimed in claim 12, further comprising an adhesive layer for adhering the metal layer and the panel unit.

28. The plasma display panel as claimed in claim 27, wherein a total thickness of the adhesive layer, the metal layer and the sheet ranges from 0.2 to 1 mm.

29. The plasma display panel as claimed in claim 27, wherein a total thickness of the adhesive layer, the metal layer and the sheet ranges from 0.6 mm to 0.95 mm.

30. A plasma display panel including a panel unit having discharge spaces defined between an upper plate and a lower plate, and a frame disposed opposite to the panel unit, comprising:

a sheet comprising one or more of silicon, urethane foam and acryl; and at least one metal layer formed between the sheet and the lower plate, which are opposite to each other wherein the hardness of the sheet is Asker C 15 to 30, and a thickness from the surface of the lower plate, which is opposite to the sheet, to the sheet ranges from 0.2 to 1 mm.

31. The plasma display panel as claimed in claim 30, further comprising an adhesive layer between the metal layer and the lower plate, for adhering the metal layer and the lower plate.

32. The plasma display panel as claimed in claim 31, wherein the thickness from the surface of the lower plate, which is opposite to the sheet, to the sheet is a total thickness of the adhesive layer, the metal layer and the sheet.

33. The plasma display panel as claimed in claim 32, wherein the total thickness of the adhesive layer, the metal layer and the sheet ranges from 0.6 mm to 0.95 mm.

34. The plasma display panel as claimed in claim 30, wherein the urethane foam comprises a plurality of fine holes, and the fine holes are filled with one of the silicon and the acryl.

35. The plasma display panel as claimed in claim 30, wherein the hardness of the sheet is Asker C 20 to 25.

36. The plasma display panel as claimed in claim 30, wherein the metal layer comprises one or more of silver (Ag), copper (Cu) and aluminum (Al).

37. The plasma display panel as claimed in claim 36, wherein a thickness of the metal layer ranges from 0.01 mm to 0.3 mm.

38. The plasma display panel as claimed in claim 30, wherein the metal layer comprises a plurality of slits.

39. The plasma display panel as claimed in claim 38, wherein the width of the slits ranges from 0.05 mm to 1 mm.

40. The plasma display panel as claimed in claim 30, wherein the sheet comprises foamed acryl.

41. The plasma display panel as claimed in claim 40, wherein the acryl has viscosity.

42. The plasma display panel as claimed in claim 41, wherein the sheet comprises a plurality of fine holes entrained within the viscous acryl.

43. The plasma display panel as claimed in claim 30, wherein the metal layer is in an electrically floating state.

44. The plasma display panel as claimed in claim 30, wherein the metal layer is grounded to a ground voltage.

45. The plasma display panel as claimed in claim 30, wherein the sheet has the color tone of gray.

* * * * *